US005897301A

United States Patent [19]

Reis

[11] Patent Number: 5,897,301

[45] Date of Patent: Apr. 27, 1999

[54] SWASH-PLATE MACHINE

[76] Inventor: Fritz Reis, Schwalbenstrasse 11, D-64732 Bad König, Germany

[21] Appl. No.: 08/891,514

[22] Filed: Jul. 11, 1997

Related U.S. Application Data

[62] Division of application No. 08/636,896, Apr. 24, 1996, Pat. No. 5,685,702, which is a continuation of application No. 08/291,183, Aug. 16, 1994, abandoned, which is a continuation of application No. PCT/EP93/03415, Dec. 4, 1993.

[30] Foreign Application Priority Data

Dec. 16, 1992 [DE] Germany ..... 42 42 449
Oct. 13, 1993 [DE] Germany ..... 43 34 874

[51] Int. Cl.[6] ..... F01C 1/02

[52] U.S. Cl. ..... 417/483; 418/53; 418/50

[58] Field of Search ..... 417/481; 418/53, 418/68, 94, 97, 98, 104, 151, 178, 52, 50, 49; 277/81 P

[56] References Cited

U.S. PATENT DOCUMENTS

| | | | |
|---|---|---|---|
| 617,946 | 1/1899 | Bassett | 418/50 |
| 984,061 | 2/1911 | Augustine . | |
| 1,848,419 | 3/1932 | Gamon | 418/50 |
| 1,880,131 | 4/1932 | Gray . | |
| 1,904,373 | 4/1933 | Kempthorne . | |
| 1,946,344 | 2/1934 | Wicha | 418/53 |
| 1,984,447 | 12/1934 | Wicha | 418/53 |
| 1,986,454 | 1/1935 | Wicha | 418/53 |
| 2,000,629 | 5/1935 | Wicha | 418/53 |
| 2,030,131 | 2/1936 | Wicha | 418/53 |
| 2,031,125 | 2/1936 | Peschi et al. . | |
| 3,019,964 | 2/1962 | Griswold . | |
| 3,549,286 | 12/1970 | Moriarty . | |
| 3,811,806 | 5/1974 | King . | |
| 3,816,038 | 6/1974 | Berry . | |
| 3,942,384 | 3/1976 | Parker . | |
| 3,988,080 | 10/1976 | Takada . | |
| 3,999,900 | 12/1976 | Reis . | |
| 4,008,014 | 2/1977 | Staebler . | |
| 4,011,031 | 3/1977 | Hackett et al. . | |
| 4,149,835 | 4/1979 | Wells . | |
| 4,737,087 | 4/1988 | Hertell . | |
| 4,923,377 | 5/1990 | Cavalleri . | |
| 5,127,810 | 7/1992 | Kolbinger . | |
| 5,147,193 | 9/1992 | Larsen . | |
| 5,454,699 | 10/1995 | Heng | 418/53 |

FOREIGN PATENT DOCUMENTS

| | | |
|---|---|---|
| 2 657 654 | 8/1991 | France . |
| 25 17 469 | 10/1976 | Germany . |
| 26 17 516 | 11/1977 | Germany . |
| 35 42 648 | 6/1987 | Germany . |
| 37 09 106 A1 | 9/1988 | Germany . |
| 2 071 213 | 9/1981 | United Kingdom . |
| 88/03986 | 6/1988 | WIPO . |
| 90/07632 | 7/1990 | WIPO . |

*Primary Examiner*—Timothy S. Thorpe
*Assistant Examiner*—Ted Kim
*Attorney, Agent, or Firm*—Herbert L. Lerner; Laurence A. Greenberg

[57] ABSTRACT

A swash-plate machine includes a hollow-spherical work chamber which is divided by a partition into at least one high-pressure chamber and one low-pressure chamber, into which an operating medium can be carried through a conduit system. The partition extends up to a piston carrier and cooperates with a plate-like sealing strip. A circular piston is adapted to the diameter of the work chamber and communicates with the exterior through a supported drive shaft which effects a tumbling motion of the piston. The piston has at least one radial slit extending from the circumference to approximately the piston carrier. A guide journal which is inserted in the slit cooperates with the partition. The piston tapers outward toward the circumference. End surfaces of the piston are in contact with opposed lateral surfaces that extend at right angles to the axis of rotation of the drive shaft and laterally define the work chamber. The guide journal disposed in the radial slit is guided in a guide groove disposed in the partition. The radial slit is provided with angled sides having an opening angle being adapted to a swiveling stroke of the piston. The guide journal cooperates with a sealing segment disposed in the piston carrier. The segment is adapted to the opening angle of the radial slit of the piston.

50 Claims, 4 Drawing Sheets

Fig.5
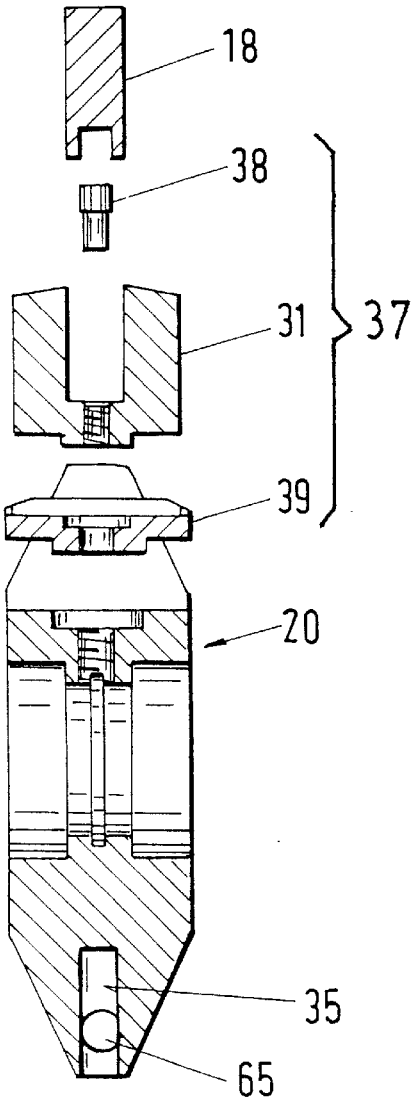
Fig.6
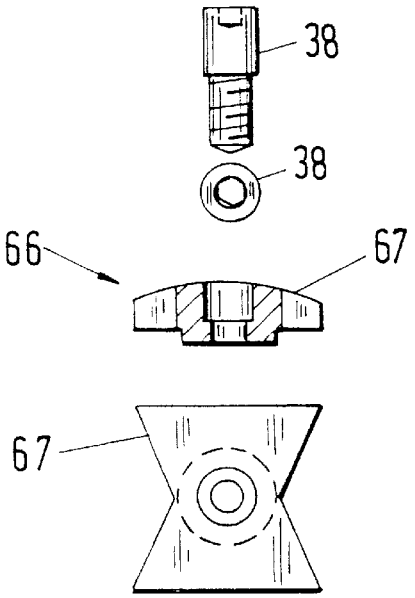
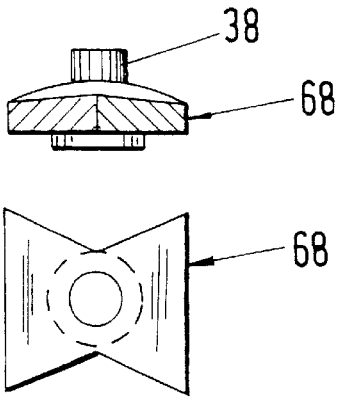
Fig.7

SWASH-PLATE MACHINE

CROSS-REFERENCE TO RELATED APPLICATION

This is a division of application Ser. No. 08/636,896 filed on Apr. 24, 1996 now U.S. Pat. No. 5,685,702 which is a continuation of Ser. No. 08/291,183 filed Aug. 16, 1994 now abandoned, is a Continuation of International Application Serial No. PCT/EP93/03415, filed Dec. 4, 1993.

BACKGROUND OF THE INVENTION

Field of the Invention

The invention relates to a swash-plate machine including a hollow spherical work chamber being divided by a partition into at least one high-pressure side and at least one low-pressure side, into which an operating medium can be conducted through a conduit system, the partition extending up to a piston carrier and cooperating with a plate-like sealing strip, a circular piston being adapted to the diameter of the work chamber and connected to the outside through a supported shaft effecting a tumbling motion of the piston, the piston having at least one piston slit extending radially from the circumference approximately to a piston carrier, and a guide journal being inserted into the slit and cooperating with the partition, the piston tapering outward toward the circumference, and the end surfaces of the piston being in contact with opposed lateral surfaces extending perpendicularly to the axis of rotation of the shaft and laterally defining the work chamber.

The invention relates to the field of swash-plate machines for pumping liquid and gaseous media, as a subcategory in the field of machines, particularly swash-plate pumps and swash-plate compressors.

One such swash-plate machine has been disclosed by German Published, Non-Prosecuted Application DE 35 42 648 A1. The teaching of that application relates to a swash-plate machine with a circular-annular piston disposed in a hollow-spherical work chamber. The piston is retained in a piston carrier and is set into tumbling motion by a drive shaft. The piston carrier, which is acted upon directly by the shaft, is in positive engagement with the piston and imposes the tumbling motion upon it. The partial work chambers located on both sides of the piston, which are formed by a partition in engagement with the piston, function as a high-pressure and low-pressure chamber, depending on the direction of rotation of the drive shaft that drives the piston carrier, and the applicable medium is delivered to and removed from those chambers.

In the case of high-viscosity media, such as molasses or heavy oil, tightness is adequately assured, with only moderate friction. However, with low-viscosity media, leaks and increased wear can arise from unavoidable friction between the piston guide and the partition.

The piston guide in that case includes a guide journal inserted into a radial slit made in the piston. In its basic form, the journal is constructed as a circular cylindrical column with a slit. The slit corresponds to the wall thickness of the partition and is engaged by the partition. In accordance with the tumbling motion of the piston produced by the piston carrier set into rotation by the drive shaft, the guide journal slides along the partition.

A provision for overcoming that disadvantage which is often employed in such cases, namely to reduce the dimensional tolerances in the known machine, particularly of the parts that move relative to one another, with one example being the width of the slit in the guide journal, has proved impracticable. Reducing the dimensional tolerances can in fact cause increased wear or even machine failure, for instance from welding resulting from excessive friction, and is therefore not an option.

SUMMARY OF THE INVENTION

It is accordingly an object of the invention to provide a swash-plate machine, which overcomes the hereinafore-mentioned disadvantages of the heretofore-known devices of this general type and which does so in such a way that friction between parts that are moving relative to one another is reduced and problem-free operation with all kinds of fluids is made possible without impairing sealing.

With the foregoing and other objects in view there is provided, in accordance with the invention, a swash-plate machine, comprising a hollow spherical work chamber having a given diameter and being laterally defined by opposed lateral surfaces; a partition dividing the work chamber into at least one high-pressure chamber and at least one low-pressure chamber; a conduit system for conducting an operating medium into the chambers; a piston carrier up to which the partition extends; a plate-like sealing strip cooperating with the partition; a circular piston having a circumference and a swivel stroke, the piston being adapted to the given diameter and tapering outwardly toward the circumference; a supported drive shaft through which the circular piston is connected to the outside for effecting a tumbling motion of the piston, the drive shaft having an axis of rotation; the piston having at least one radial slit extending radially therein from the circumference of the piston approximately to the piston carrier, defining angled sides of the radial slit with an opening angle being adapted to the swivel stroke of the piston; a circular-cylindrical guide journal being inserted in the slit and cooperating with the partition; the piston having end surfaces being in contact with the opposed lateral surfaces, the opposed lateral surfaces extending perpendicularly to the axis of rotation of the drive shaft; the partition having a guide groove formed therein in which the guide journal disposed in the radial slit is guided; and a sealing segment disposed in the piston carrier, the guide journal cooperating with the sealing segment, and the sealing segment being adapted to the opening angle of the radial slit.

This embodiment described above is especially to be considered for high-speed operation of the swash-plate machine of the invention, since the surface areas that engage or are in contact with one another are reduced considerably in comparison with the known swash-plate machine, and moreover additional friction-reducing provisions are possible.

In accordance with another feature of the invention, the rotationally movable guide journal is supported in the bottom of the radial slit through an axial bearing. This produces further reduction of friction, because instead of static friction, only the markedly lesser rolling resistance of the rotationally movable cylindrical guide journal in the guide groove, in the end of the partition toward the work chamber, stands in the way of the tumbling motion of the piston. If at all, friction occurs at most in the form of sliding friction, and then only linearly along the line of contact on the pressure side of the circular-cylindrical guide journal with the inner guide groove wall surface extending at a tangent thereto.

This configuration is therefore excellently suited for operation of the swash-plate machine of the invention as a high-pressure pump or as a compressor. In both cases, but especially in operation as a compressor, according to the invention the guidance of the radial piston in a guide groove in the partition by means of the rotationally movable guide journal inserted into the radial slit proves to be very resistant to wear, even at high operating rpm.

In accordance with a further feature of the invention, the partition that engages the radial slit disposed in the piston encompasses the guide journal on two opposite sides with the guide groove at a certain tolerance, so that only one side of the two possible contact surfaces at a time, namely the applicable inner wall side of the guide groove in the partition, is acted upon by force, while the opposite side is released. As a result, in a further feature of the invention, highly advantageous wear reduction is achieved, because of the comparatively slight, nearly negligible friction.

With the objects of the invention in view, there is also provided a swash-plate machine, comprising a hollow spherical work chamber having a given diameter and being laterally defined by opposed lateral surfaces; a partition dividing the work chamber into at least one high-pressure chamber and at least one low-pressure chamber; a conduit system for conducting an operating medium into the chambers; a piston carrier up to which the partition extends; a plate-like sealing strip cooperating with the partition; a circular piston having a circumference and a swivel stroke, the piston being adapted to the given diameter and tapering outwardly toward the circumference; a supported drive shaft through which the circular piston is connected to the outside for effecting a tumbling motion of the piston, the drive shaft having an axis of rotation; the piston having at least one radial slit extending radially therein from the circumference of the piston approximately to the piston carrier, defining slit or angled sides having opening angles being adapted to the swivel stroke of the piston and defining a slit bottom with a radius; a guide journal being inserted in the slit and cooperating with the partition; the piston having end surfaces being in contact with the opposed lateral surfaces, the opposed lateral surfaces extending perpendicularly to the axis of rotation of the drive shaft; and the partition having an end surface engaging the radial slit, the slit bottom and the end surface of the partition each having a spherical curvature being matched to one another and adapted to the radius of the slit bottom.

Unlike the first version, the piston, although it does also have a radial slit, nevertheless has no guide journal. Instead, guidance of the radial piston is attained by means of the sides adapted to the swivel stroke of the piston. In order to reduce the resultant friction, the common area of contact of the piston and partition end surface are adapted to one another in shape. This provides very good sealing action, although with the swash-plate machine of the invention constructed in this way, operation is possible only at low rpm.

In accordance with another feature of the invention, there are provided force-impinged, tangentially moved sealing rollers, which press against the partition and are disposed in the radial slit on either side of the engagement of the partition with the radial slit of the piston.

These sealing rollers have a dual function. On one hand, as their name indicates, they serve to seal off the two pressure chambers from one another. On the other hand, however, they also serve to guide the piston. Due to the circular-cylindrical form of the sealing rollers, there is only a linear contact area between the sealing rollers and the piston at any time. The resultant friction is accordingly virtually negligible.

However, in accordance with a further feature of the invention,, instead of the sealing rollers, sealing lips may be provided, which likewise have a rounded contact surface, equivalent to a half cylinder, for the partition and moreover are movable tangentially, so that they always conform to the partition.

In accordance with an added feature of the invention, in order to provide further reduction of the resultant sliding friction, the pairing of materials between the sealing lip and partition may be chosen in such a way that a certain lubricating effect and at the same time an improved sealing action arise, for instance by using bearing metal for the sealing lips.

In accordance with an additional feature of the invention, the sealing rollers are acted upon by compression springs which press the sealing rollers against the partition.

In accordance with yet another feature of the invention, the sealing rollers are acted upon by pressure medium from the work chamber, and optionally, mechanical springs may also be provided.

In accordance with yet a further feature of the invention, the sealing strip is disposed like a piston ring, in a circumferential groove on the piston. The sealing strip is suitably made of resilient material and placed in the circumferential groove in such a way that it always presses with adequately high contact force against the inner wall surface of the work chamber.

In accordance with yet an added feature of the invention, the sealing strip can be pressed against the housing additionally, or only exclusively, by the operating medium, thereby considerably improving the sealing action without intolerably strong frictional forces being involved.

With the aid of the provisions according to the invention for modifying the known swash-plate machine, it now becomes possible as well to pump low viscosity and gaseous media, without danger to the moving parts from excessive friction because of inadequate lubrication. For that purpose, provision is made so that the regions which are especially strained by friction from relative motion, such as the piston guide in the partition and the lateral surfaces of the radial slit in the piston, are protected against intolerable friction by means of special provisions.

In accordance with yet an additional feature of the invention, in one such provision there are provided tangentially moving roller-like parts being acted upon by force and being disposed in the lateral surfaces of the radial slit. These parts serve to guide the piston along the partition engaging the slit and simultaneously serve to seal off the partial work chambers formed by the piston and the partition.

In accordance with again another feature of the invention, the guide bodies or sealing rollers are pressed against the partition by compression springs and thus are in continuous contact with the partition and assure good sealing. The spring force should be dimensioned in such a way that on one hand an adequate contact pressure is brought to bear, and on the other hand, intolerably strong friction will not result.

In accordance with again a further feature of the invention, instead of a compression spring, the sealing rollers are acted upon by pressure fluid from the respective partial work chamber, so that only the contact force required for sealing purposes at the prevailing pressure are ever brought to bear.

In accordance with again an added feature of the invention, the compression springs are provided for pressing the sealing rollers jointly with the imposition of the pressure fluid on them, thereby assuring that even in the pressureless state, for instance when the swash-plate machine is stopped, sealing against a minimum pressure is assured.

In accordance with again an additional feature of the invention which is especially intended for use in pumping contaminated liquids, the piston for the swash-plate machine, on at least one end surface, and in at least some regions, has radially extending grooves that are defined by knife-like ribs. This ensures that the contaminants, such as chips and sawdust in paper production, bones in fish processing, or fruit or grape residues in winemaking and must production, cannot jam between the piston and the inner wall surface of the work chamber and thus impair the pumping action of the swash-plate machine.

In accordance with still another feature of the invention, there is provided a sector of a circle, having an angle bisecting line that extends at right angles to the axis of the piston slit, being located in the region of the piston provided with the radial grooves.

In accordance with still a further feature of the invention, the radial grooves are provided on both ends of the piston, and the grooves are disposed on the applicable end of the piston in a sector having one side which adjoins the piston slit.

In accordance with still an added feature of the invention, the piston regions provided with the grooves are each disposed on the opposite ends of the piston in such a way that a parting plane of the piston located along the piston slit axis subdivides the piston into a first piston half with radial grooves or radially extending knife-like ribs and a second half with smooth piston surfaces, without grooves and ribs.

In accordance with still an additional feature of the invention, in order to provide problem-free operation, it is significant if the smooth piston region is disposed on the suction side, while the groove region of the piston provided with knife-like ribs is disposed on the pressure side thereof. This means that a change of rotational direction involving a change from the suction side to the pressure side and vice versa should be avoided, because otherwise upon aspiration, due to the interstices resulting from the grooves, leaks might possibly result between the piston surface and the work chamber wall surface, which in turn would mean that the negative pressure required for pumping the applicable fluid could not be created.

In accordance with another feature of the invention, the grooves are provided only on the beveled end surfaces of the piston that come into contact with the work chamber wall surface. Conversely, the other end surface of the piston is smooth, or in other words lacks grooves and ribs.

An inside diameter of 15 mm on the inner circumference is preferentially provided as the maximum groove width, or in other words at the radius where the beveling of the piston begins. The groove depth is in a certain proportion to the groove width, and in accordance with a further feature of the invention, it amounts to 4 mm, for instance, corresponding to 40% of the associated groove widths.

In principle, however, in accordance with an added feature of the invention, the width of the radially disposed grooves is provided in accordance with an angular distribution of 7.5 2.5. It follows from this that the inside diameter of the grooves adapts to the particular piston diameter, so that wide grooves also result when the piston dimensions are large. This proves to be advantageous for operation in the sense that with a swash-plate machine having a large piston diameter, typically large flows of media are pumped, and these media often also include relatively large-sized extraneous components.

In accordance with an additional feature of the invention, the grooves have a quadrilateral profile. This can preferably be a rectangular profile but has a flat or curved course in the longitudinal direction of the groove. However, it may also be advantageous for the strength of the ribs that demarcate the grooves from one another for the grooves to have a trapezoidal profile with a flat groove bottom and beveled groove sides.

In accordance with yet another feature of the invention, the grooves are profiled asymmetrically with respect to their longitudinal axes, or have a V profile with a narrow groove bottom and sides with the same or different slopes. It is advantageous if the sides toward the piston slit of each groove, that is the sides that are each located closer to the piston slit, slope more steeply than the opposite sides. As a result, when the piston rolls along the work chamber wall surface, the solid materials being pumped are entrained uniformly, as with a shovel, without dropping back.

In accordance with yet a further feature of the invention, a positioning angle of the groove sides toward the piston slit is 105° to 120° relative to the groove bottom, and preferably 112°, and the positioning angle of the opposite groove sides is >135° relative to the groove bottom.

In accordance with yet an added feature of the invention, the knife-like ribs defining the grooves have a blade-like outer edge and by comparison with it a broader base on the groove bottom, which reinforce the respective rib. This is advantageous for pumping fluid media that are enriched with solids.

In accordance with yet an additional feature of the invention, in order to reduce wear on the piston or its piston surfaces provided with the grooves and knives, the groove-like ribs are surface hardened.

In accordance with again another feature of the invention, instead or optionally in addition, the knife-like ribs have a coating with a wear-resistant material.

In accordance with again a further feature of the invention, the ribs are made of hard metal as separated inserts and are inserted into the piston.

In accordance with again an added feature of the invention, particularly for use in winemaking, the piston is made of non-rusting material, preferably steel.

In accordance with again an additional feature of the invention, particularly with pistons of large diameter, the groove bottom receiving the knife-like ribs is constructed as a separately produced piston part that is joined to the piston.

In practical operation, the effect of the knife edge-like outer edge of each rib is that as the piston successively rolls along the inner wall surface of the work chamber, solid ingredients located between it and the piston are not crushed, as before, causing possible leaks from the work chambers, but rather are severed and thus comminuted by the sharp knife edge of each rib. In this respect the inner wall surface of the work chamber functions as a blade support, something like an anvil. It is therefore easily possible, for instance, to pump any fluid media with solid ingredients, such as sawdust in the papermaking industry, or the must mixed with stalks in winemaking. The aforementioned problem that may arise under some circumstances if the piston region provided with grooves is used on the suction side, has no relevance on the pressure side, because in this case already pumped solid ingredients are present in the piston work chamber and fill the grooves and thus contribute to sealing.

In accordance with still another feature of the invention, that seeks to avoid problems in pumping media that are mixed with granular contaminants, the piston is provided with a soft coating on its piston surfaces, preferably only in the beveled region.

In accordance with a concomitant feature of the invention, the soft coating is formed of rubber and is vulcanized onto the steel piston blank. Instead, it is also possible to provide a flexible but wear-resistance plastic as the soft coating instead of rubber. In each case, the soft coating has the effect of preventing the granular admixtures, such as sand, granulate, gravel or the like, from causing leaks in pumping operation, since the piston always rests with its sealing surface against the work chamber wall surface, and any contaminants that might be located between them press into the soft coating or are removed beforehand with a spatula.

Other features which are considered as characteristic for the invention are set forth in the appended claims.

Although the invention is illustrated and described herein as embodied in a swash-plate machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 5 is an exploded view of a piston configuration with a first sealing segment having a guide journal in place and lateral slit sides;

FIG. 6 is an exploded view of a second sealing segment;

FIG. 7 is an exploded view of a third sealing segment with an integrally formed guide journal;

DESCRIPTION OF THE PREFERRED EMBODIMENTS

Figure 1:
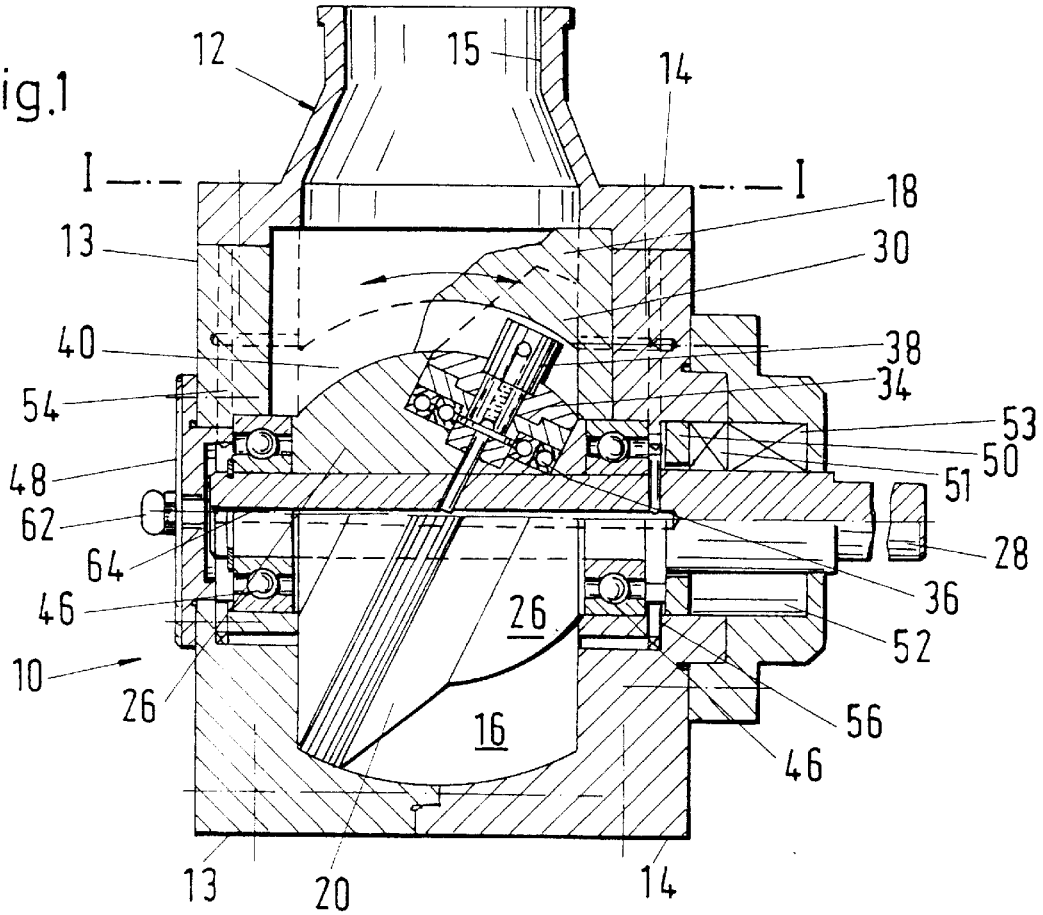
FIG. 1 is a diagrammatic, longitudinal-sectional view of a swash-plate machine according to the invention with a guide journal guided on the inside.

Referring now to the figures of the drawing in detail and first, particularly, to FIG. 1 thereof, there is seen a longitudinal section which shows a swash-plate machine 10 according to the invention, that has a housing 12 formed of a left housing part 13 and a right housing part 14, with a work chamber 16 being provided in the housing. The two housing parts 13, 14 forming the housing 12 are held together in a known manner by screw fastening.

Figure 2:
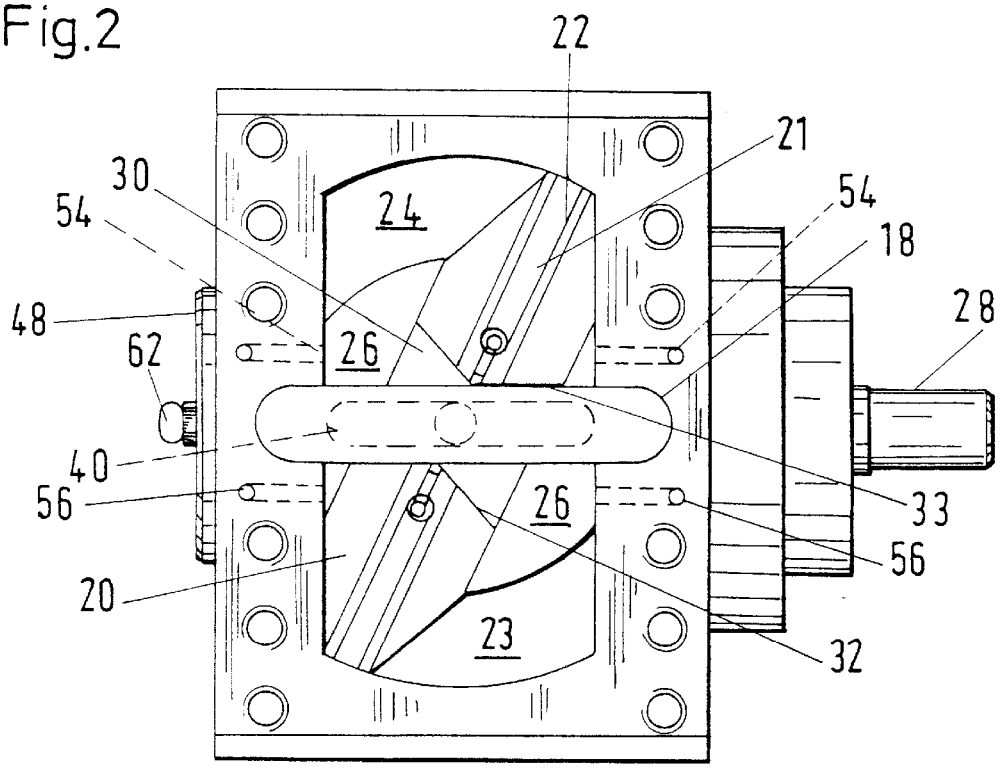
FIG. 2 is a cross-sectional view taken along a line I—I of FIG. 1, showing a plan view of a piston.

In the work chamber 16, which is constructed spherically, a partition 18 together with a circular-annular piston 20 divide the work chamber 16 into a high-pressure chamber 23 and a low-pressure chamber 24 seen in FIG. 2.

The piston 20 is retained by a piston carrier 26 that is mounted on a drive shaft 28. The drive shaft 28 is extended laterally to the outside, where it can be acted upon by a non-illustrated motor.

The piston carrier 26 is assembled in a known fashion from two halves having a parting line which is positioned obliquely, or in other words at an angle relative to the drive shaft 28, so that again in a known fashion, the piston 20 which is inserted between the two halves of the piston carrier is also positioned obliquely relative to the longitudinal axis of the drive shaft 28. For that reason, a peripheral region of the piston 20, or in other words its region near the circumference, is beveled in accordance with a maximum pivoted position caused by a tumbling motion, and as a result on one hand its full mobility inside the work chamber is assured, while on the other hand simplified manufacture is made possible as compared with the swash-plate machine known from the prior art.

A side of the piston 20 pointing toward the partition 18 has a radial slit 30, which is engaged by the partition 18. Sides 32, 33 of the radial slit 30 are beveled in accordance with a swivel stroke of the piston 20, as can be seen from FIG. 2. Disposed in a bottom 34 of the radial slit 30 is a sealing segment 37, which is supported by means of axial bearings that in this case are constructed as a roller bearing, and to which a guide journal 38 is attached.

The guide journal 38 is a circular-cylindrical body that is inserted centrally into the slit bottom 34 and is guided on two sides by a guide groove 40 formed in the side of the partition 18 facing toward the piston 20. The guide journal 38 guided in the guide groove 40 serves to prevent a piston 20 that is set into a tumbling motion by the rotating piston carrier 26 from rotating with the piston carrier. Instead, because of the guidance of the guide journal 38 in the guide groove 40, the piston moves back and forth, in which motion it executes a swiveling movement, corresponding to the angular positioning of the piston carrier 26 relative to the drive shaft 28. Overall, this swiveling movement takes the form of a tumbling motion. The swivel path, or in other words the swivel stroke, of the piston is adapted to the intended use, for instance as a high-pressure pump or as a compressor. In other words, the higher the operating rpm intended for the drive shaft, the higher the swivel or tumbling frequency, and the shorter the swivel path or stroke, in order to assure safe function of the swash-plate machine 10.

In order to improve sealing of the piston 20 at the inner wall surface of the work chamber 16, a sealing strip 21 is placed in a circumferential groove 22 in the piston 20. In a manner similar to a piston ring, the sealing strip 21 presses against the inner wall surface of the work chamber 16 and thus assures good sealing off of the low-pressure chamber 23 from the high-pressure chamber 24, with comparatively slight friction.

In FIG. 2, the swash-plate machine 10 of FIG. 1 is shown in a sectional view from above, with the section being taken along the line I—I of FIG. 1. For purposes of explanation and for better comprehension, the same reference numerals as in FIG. 1 are used for the same features.

It is particularly in this view that the configuration of the guide groove 40 in the end surface of the partition 18 facing toward the piston 20 can be seen. The partition encompasses the guide journal on both sides and in idealized fashion touches only at the applicable tangential line. From this it can easily be understood that with this embodiment, as compared with the prior art, a considerable advantage in terms of friction reduction is attained, because after all, the contact surfaces that are in contact with one another in the swash-plate machine of the invention in each case are only a line of very slight length. Conversely, in the prior art, the area of contact between the partition and the guide journal provided therein is formed by its entire slit area.

Figure 3:
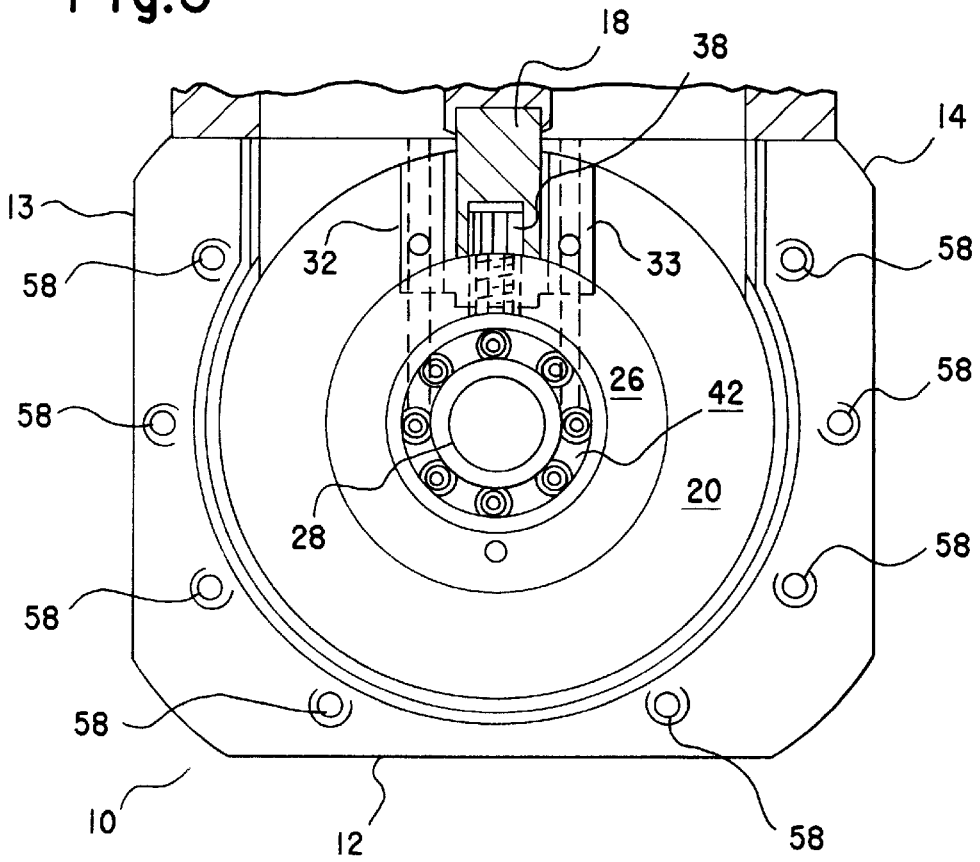
FIG. 3 is a fragmentary, longitudinal-sectional view of a work chamber with the piston inserted and piston guidance in the swash-plate machine of the invention.

Both in FIG. 1 and in FIGS. 2 and 3, lubricant conduits or bores 54 and vent conduits or bores 56 are shown. On one hand the conduits or bores serve to adequately provide lubricant to the slide surfaces which are moving relative to one another, such as the guide journal 38 and the guide groove 40, as well as bearing points such as first and second piston bearings 42, 44 in the piston carrier 26, or an axial bearing 36 in the slit bottom 34 and support bearings 46 for supporting the drive shaft 28. On the other hand and at the same time the conduits or bores prevent an oversupply of lubricant, because excess lubricant is automatically removed by suction from the swash-plate process by means of negative pressure.

Reference numerals 58 designate housing screws that serve to connect the two housing parts 13, 14 of the swash-plate machine housing 12. The housing screws are disposed concentrically around the work chamber 16 in order to assure that no leaks or housing offset can ensue, which would have disadvantageous consequences for operation.

Figure 4:
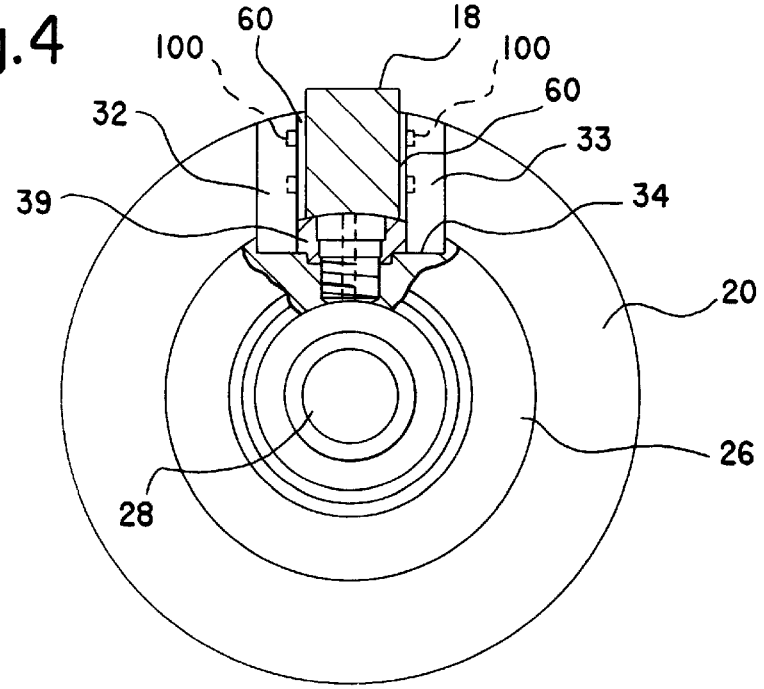
FIG. 4 is a side-elevational view of a piston without a guide journal, showing the piston and a partition region partly in section.

FIG. 4 shows a view similar to FIG. 3, namely a side view of the circular-annular piston 20, but in this case it has a different piston guide along the partition 18, which is intended for operation at low operating rpm. The guidance of the piston 20 is attained in this case not by a guide journal 38, which is not present in this case, but solely by the sides 32, 33 of the radial slit 30, which press tightly against the partition 18 engaging the radial slit 30.

In order to provide further friction reduction, so-called sealing rollers 60 are disposed at two mutually facing apexes of the oppositely angled sides 32, 33. These sealing rollers 60 each press against the partition 18, under the influence of a compression spring 100 and/or the influence of an operating fluid being used.

Due to the above-described configuration of lubricant bores or conduits 54 and vent bores or conduits 56 in the high-pressure chamber 23 and the low-pressure chamber 24, corresponding to one embodiment of the invention, the opportunity exists of uniformly lubricating the bearing points 42, 44, 46 both in the housing 12 and in the piston 20, as well as of keeping a radial packing ring 51 which is provided to seal off a shaft leadthrough and a stuffing box 53 or a slide ring seal 52 being used as an alternative instead of these two seals, quasi-pressureless, or in other words of relieving them of pressure of the medium. To that end, a vent bore 56 is provided at the lowest point of each applicable packing ring 51, seal 52 and so-called impact plate 50. The impact plate 50 is provided as an advantageous further feature of the invention in order to protect the packing ring 51 or the seal 52, which are intended for sealing the shaft leadthrough and are directly exposed to action by the lubricant fluid, from mechanical damage by the pressure stream of the lubricant fluid. The impact plate 50 is made of a metallic material and brings about a considerable reduction in the mechanical strain on the packing ring 51 or seal 52.

The seal 52 which is used in this case is a conventional slide ring seal, because the mechanical action by the stream of lubricant medium which is at high pressure, survives without problems or in other words malfunctions for only a short operating time of a few hundred hours in operation. This considerably increases operating costs because of the need for spare parts and the necessary down time of the swash-plate machine 10 of the invention required for replacement. Conversely, with the impact disk 50 that is provided, which surroundingly engages the drive shaft 28 with adequate play, a substantially longer service life is attainable, which proves to be advantageous in all respects. The aforementioned play of the impact disk or impact plate 50 prevents an undesired pumping effect for the lubricant, which unavoidably occurs if the fit between the drive shaft 28 and the impact disk 50 is too close, and pumps lubricant into the sealing region of the shaft leadthrough of the shaft 28 through the housing, which would promote leaks but is thus prevented.

In a possible use of the swash-plate machine 10 according to the invention as a compressor, a practical further feature provides that the lubrication of the bearing points 42, 44, 46 is carried out by importing extraneous lubricant through a lubricant connection 62, for instance in the form of a ball valve, to which a lubricant hose, which is not illustrated in detail in this case but is well known in the prior art, can be attached with a plug-type coupling. Through the use of this external lubricant supply, the individual bearing points 42 and 44 in the piston 20, including the guide journal 38, the support bearings 46 and the housing 12 for supporting the drive shaft 28, are supplied with the proper quantity of lubricant through a lubricant conduit 64 being disposed in the drive shaft 28 and constructed as a central bore. Moreover, the guide groove 40 in the end surface of the partition 18 is also included in this lubricant circuit along with the guide journal 38 in the piston 20. The lubricant is supplied at adequate pressure through the lubricant connection 62, and it can flow out again on the low-pressure side through the aforementioned vent bores, in order to keep the pressure chamber free of lubricant and thus to avoid an undesirable enrichment of the compressed air with lubricant, such as oil.

According to the invention, with an opposite direction of rotation of the drive shaft 28 of the swash-plate machine 10, the lubricant conduits 54 act as vent bores, and conversely the vent bores 56 act as lubricant conduits. With a view toward this dual type of use, the lubrication system with the bores 54, 56 may be suitably structurally configured with non-illustrated ball valves or the like.

A further advantage that results from a preferred further feature of the invention, namely the provision that the guide journal 38 is disposed with adequately great play in the partition groove, is also provided due to the fact that because of the above-described vent system 56, the differing pressure conditions from low pressure to high pressure involve a reduction in contact pressure of the guide journal 38 against the inner wall surface of the guide groove 40, so that the possible friction wear resulting therefrom is greatly reduced, thus considerably lengthening the life of the swash-plate machine of the invention.

FIG. 5 is an exploded view which is seen in a longitudinal section and in a side view and shows a piston configuration with a first sealing segment 37 for use in a swash-plate machine of FIG. 1. The sealing segment 37 includes an insert piece 39, a radial slit element 31 and the guide journal 38 disposed therein, which is intended for engagement with the guide groove 40 formed in the end wall surface toward the pressure chamber of the partition 18, and which journal connects the radial slit element 31 to the insert piece 39 and the piston 18 by means of a detachable connection, such as a thread or screw connection. This variant offers the advantage of reducing the aforementioned friction wear even further, by a suitable pairing of materials forming the guide journal 38 and the partition 18 with the guide groove 40, or the optionally provided lining of its inner wall surface.

A further function of the sealing segment 37, beyond its retention function for the guide journal 38, is to receive the radial slit 30. With the aid of the X-shaped radial slit 30 having the lateral sides 32, 33 disposed at an angle to one another and with the sides being engaged in a tight fit by the partition 18, the swivel angle of the piston 20 and thus its swivel stroke are limited, as was already explained in conjunction with FIG. 1. Once again, the opportunity exists of improving the requisite sealing action and reducing the incident friction wear by a suitable choice of materials.

It can also be seen from FIG. 5 that the piston 20, on the side opposite the radial slit 30 or the sealing segment, has a radial recess 35, in which a body 65 of circular cross section is disposed. The radial recess 35 serves to equalize imbalances of the piston 20 that result from the removal of material which occurs when the X-shaped radial slit 30 is made. By installing the body or balance weights 65 in the radial recess 35, an equalization of weight is made possible, even if a radial slit 30 with a different geometry and as a result with less removal of material, is used.

FIG. 6 shows a second sealing segment 66 in a side view and below it in a plan view, as it can be used instead of the sealing segment 37 shown in FIG. 5. However, unlike the sealing segment 37 shown in FIG. 5, the sealing segment 66 shown in this case has no radial slit element, but instead has only an insert piece 67. The swivel path of the piston 20 is limited in this case by the radial slit 30 being formed in the piston and provided with the sides 32, 33. In order to improve the sealing between the partition 18 and the piston 20, the insert piece 67 is spherically curved on its surface that carries the guide journal 38. The curvature is compatible with the structure of the corresponding side of the partition 18. In order to provide unequivocal fixation in the piston 20, the insert piece 67 has V-shaped formed-in features on two opposed sides, which are congruently equivalent to the X-shaped radial slit 30 in the piston 20.

FIG. 7 shows a third sealing segment 68 in a side view and below it in a plan view, as it can be used instead of the sealing segment 37 or 66 shown in FIG. 5 or FIG. 6. Unlike the sealing segments 37 and 66 shown in FIGS. 5 and 6, the sealing segment 68 shown in this case is integrally joined to the guide journal 38. Otherwise, its construction is equivalent to the second sealing segment 66 that is shown in FIG. 6. It accordingly likewise has no radial slit element but instead has a spherically curved surface and V-shaped formed-in features located on two opposed long sides, which are congruent with the X-shaped radial slit 30 in the piston 20 and thus assure a firm seat in the piston 20.

In summary it should be pointed out that the lubrication system provided in the swash-plate machine of the invention, which makes use of the different pressures of the pumping system, functions very cleanly, economically and efficiently because of the removal of excess lubricant by negative pressure.

Figure 8:
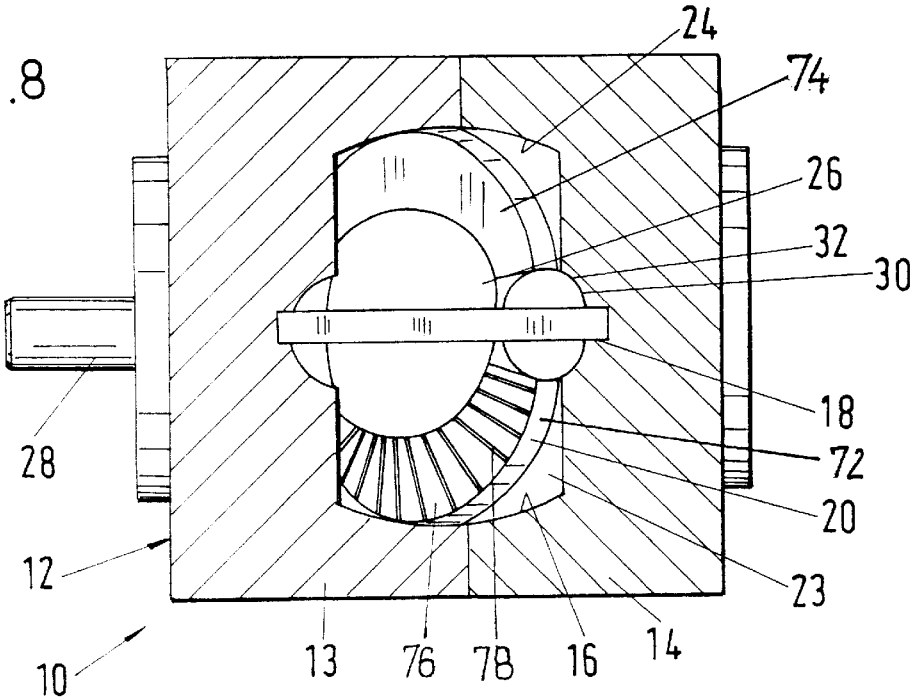
FIG. 8 is a longitudinal-sectional view of the work chamber of the swash-plate machine of FIG. 1 with a new piston having radial grooves.

FIG. 8 is a view through the swash-plate machine 10 of FIG. 1, which has a new piston 20 in its work chamber 16. The two housing parts 13, 14 forming the housing 12 are held together in a known manner by a non-illustrated screw connection. In the work chamber 16, which is constructed spherically, there is the partition 18 that together with the circular-annular piston 20 divides the work chamber 16 into the high-pressure chamber 23 located at the bottom, and the suction or low-pressure chamber 24 located at the top.

The piston 20 is retained by the piston carrier 26 that is mounted on the drive shaft 28. The drive shaft 28 is extended laterally to the outside, where it can be acted upon by a non-illustrated motor.

In this case again, in a fashion which is known and is therefore not illustrated in this case, the piston carrier 26 is assembled from two halves having a parting line which is positioned obliquely, or in other words at an angle relative to the drive shaft 28, so that again in a known fashion, the piston 20 which is inserted between the two halves of the piston carrier is also positioned obliquely relative to the longitudinal axis of the drive shaft 28. The peripheral region of the piston 20, or in other words its region 33, 34 near the circumference, is beveled, so that it can press with its piston surfaces 33, 34 against the inner wall surface of the work chamber 16 in accordance with the maximum pivoted position caused by the tumbling motion, and as a result its full mobility inside the work chamber is assured.

The side of the piston 20 pointing toward the partition 18 has the radial slit 30, which is engaged by the partition 18. The guide journal 32 that absorbs the swiveling forces of the piston 20 is inserted into the radial slit 30. The guide journal 32 guided in the radial slit 30 serves to prevent the piston 20 set into a tumbling motion through the rotating piston carrier 26 from rotating with the piston carrier. Instead, because of the guidance of the guide journal 32 in the radial slit 30, the piston moves back and forth, in which motion it executes a swiveling movement, corresponding to the angular positioning of the piston carrier 26 relative to the drive shaft 28. Overall, this swiveling movement takes the form of a tumbling motion.

In order to avoid problems when pumping fluid media enriched with solid ingredients such as fibers, chips, bones, straw, granulate, trimmings, or the like, the piston 20 has grooves 76 defined by knife-like ribs 78, on two pressure piston surfaces 72 belonging to the pressure chamber 23. The knife-like ribs 78 have the task of cutting apart the solid ingredients that get between the piston surface 72 and the inner wall surface of the work chamber 16 during the pivoting motion of the piston 20. The hollow space in each of the grooves 76 serves to temporarily receive the comminuted residues, and moreover a certain sealing effect is attained until the thus-comminuted ingredients are pumped onward.

By comparison, the suction piston surface 74 is left smooth, in other words it lacks grooves or ribs. The reason for this is to build up an adequate negative pressure to aspirate the particular fluid to be pumped. If the piston surfaces 74 were profiled on the suction side, this would lead to problematic leaks that would prevent the generation of the requisite negative pressure. In comparison, possible jamming of solid ingredients between the piston surface 74 and the inner wall surface of the work chamber 16, is not as problematical. In any case, the tightness achieved suffices to build up the desired negative pressure.

Figure 9:
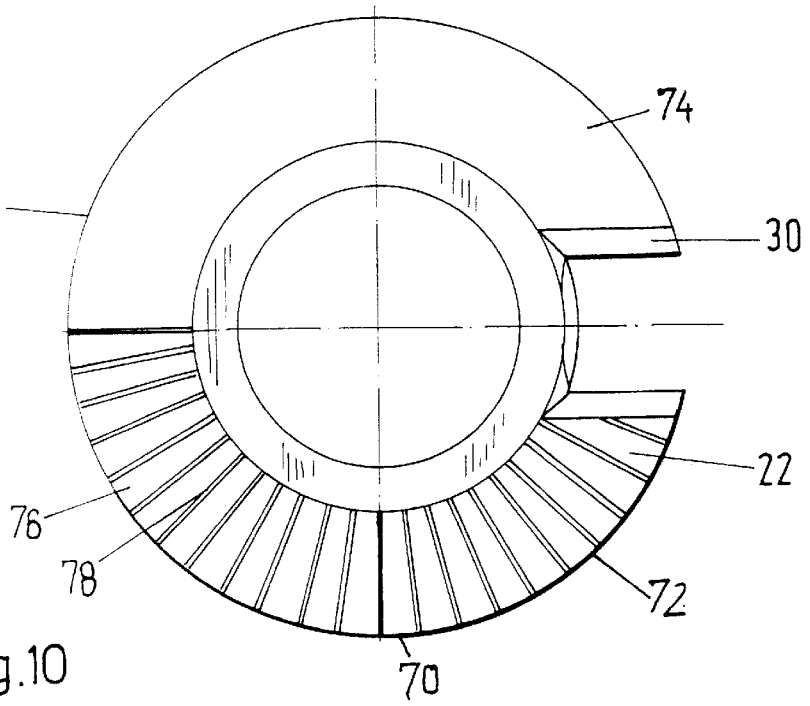
FIG. 9 is a side-elevational view of the new piston.

In FIG. 9, the piston 20 of FIG. 8 is shown in a side view, that is with a pressure piston surface 72 provided with grooves 76 and ribs 78 and with a smooth suction piston surface 74. For purposes of explanation and for better comprehension, the same reference numerals as in FIG. 8 are used for the same features in this case.

Particularly in this view, the disposition of the grooves 76 and the ribs 78 and their radial alignment and position relative to the radial slit 30 can be seen. The non-illustrated radial slit surrounds the guide journal 32, on both sides. The groove width depends on the particular piston diameter and can be provided approximately with an angle division of about 7.5 2.5.

Figure 10:
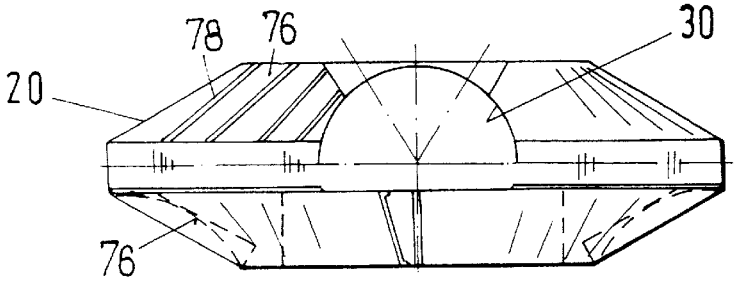
FIG. 10 is a plan view composed of two views, as seen from directions at 90° relative to one another, on an end of the new piston.

Finally, FIG. 10 is a view from two different directions on the end surface of the piston 20, with a partial section through a piston surface, from which the longitudinal profile of the grooves 76 can be seen. A view of the radial slit 30 is provided above a dividing plane represented by dash-doted lines. Below that, a view pivoted by 90 is shown.

The grooves 76 can accordingly be constructed either as continuous grooves with a rectilinear or in other words flat groove bottom, or with a curved groove bottom (as is shown in dashed lines). The latter variant is of lesser effect than that with a flat groove bottom, with a view toward the sought-after cutting action of the ribs 78 that define the grooves 76. On the other hand, this construction has a more advantageous service life, which lengthens the time it can be used.

During pumping operation, the medium being pumped is aspirated on the suction side of the piston 20 and pumped by the tumbling motion from the suction chamber 24 into the pressure chamber 23, where if necessary the knife-like ribs 78 comminute the solid ingredients in the medium being pumped.

As was already mentioned, the grooves 76 are oriented radially, as are the ribs 78 defining them. The groove width at the outer circumference can be up to 5 to 10 mm, depending on the piston diameter. In combination with the tumbling motion of the piston 20, the radially oriented grooves 76, or the groove sides of the ribs 78 defining them, assure that the material being pumped, in particular the solid ingredients, is automatically entrained as the piston 20 rolls along the wall of the work chamber 16 and is held as if in a pocket, so that the product being pumped does not remain behind and cause a backup but rather is continuously pumped onward. In this way, it is possible to pump out even media that are difficult to feed.

The thickness of the ribs is preferably 1 mm 0.5 mm. By suitable machining, the rib cross section can be made conical, with a broad base and a narrow outer edge. This improves the cutting action of the ribs 78 on one hand, and at the same time increases their service life on the other hand.

I claim:

1. A swash-plate machine, comprising:

a hollow spherical work chamber having a given diameter and being laterally defined by opposed lateral surfaces;

a partition dividing said work chamber into at least one high-pressure chamber and at least one low-pressure chamber;

a conduit system for conducting an operating medium into said chambers;

a piston carrier up to which said partition extends;

a plate-like sealing strip cooperating with said partition for sealing off said at least one low pressure chamber and said at least one high-pressure chamber;

a one-piece circular piston having a circumference and a swivel stroke, said piston being adapted to said given diameter and tapering outwardly toward the circumference;

a supported drive shaft through which said circular piston is connected to the outside for effecting a tumbling motion of said piston, said drive shaft having an axis of rotation;

said piston having at least one radial slit extending radially therein from the circumference of said piston approximately to said piston carrier, defining slit sides being adapted to the swivel stroke of said piston and defining a slit bottom with a radius;

a guide journal being inserted in said slit and cooperating with said partition;

said piston having end surfaces being in contact with said opposed lateral surfaces, said opposed lateral surfaces extending perpendicularly to the axis of rotation of said drive shaft; and said partition having an end surface engaging said radial slit, said slit bottom and said end surface of said partition each having a spherical curvature being matched to one another and adapted to the radius of said slit bottom.

2. The swash-plate machine according to claim 1, wherein said sealing strip is disposed in a circumferential groove formed in said piston.

3. The swash-plate machine according to claim 1, including a housing against which said sealing strip is pressed by the operating medium.

4. The swash-plate machine according to claim 1, wherein said lateral surfaces of said work chamber are spherical wall surfaces.

5. The swash-plate machine according to claim 1, including force-actuated sealing rollers being disposed on both sides of said partition in said radial slit in said piston.

6. The swash-plate machine according to claim 5, including compression springs acting upon said sealing rollers for pressing said sealing rollers against said partition.

7. The swash-plate machine according to claim 5, wherein said sealing rollers are acted upon by pressure medium from said work chamber.

8. The swash-plate machine according to claim 1, including first and second piston bearings being disposed on both sides of said at least one radial slit for guiding said piston in said piston carrier.

9. The swash-plate machine according to claim 8, wherein said first and second piston bearings are roller bearings.

10. The swash-plate machine according to claim 1, including a housing and lubricant and vent conduits disposed in said housing.

11. The swash-plate machine according to claim 10, including means for delivering an external lubricant to said lubricant conduits from outside said housing.

12. The swash-plate machine according to claim 11, wherein said external lubricant delivering means include at least one lubricant connection communicating with said lubricant conduits and vent conduits in said housing.

13. The swash-plate machine according to claim 11, wherein said drive shaft has end surfaces, said external lubricant delivering means include at least one lubricant connection disposed on one of said end surfaces of said drive shaft, and said drive shaft has a lubricant conduit formed therein as a central bore.

14. The swash-plate machine according to claim 10, wherein said vent conduits are acted upon by negative pressure from said low-pressure chamber and remove excess lubricant from locations to which lubricant is supplied.

15. The swash-plate machine according to claim 1, wherein said piston has a multi-part sealing segment including an insert piece and said guide journal connecting said insert piece to said piston by a screw connection.

16. The swash-plate machine according to claim 1, wherein said piston has a one-piece sealing segment being formed by an insert piece with said guide journal being integrally formed.

17. The swash-plate machine according to claim 1, wherein said piston has a side disposed opposite said radial slit, said side having a radial recess formed therein for equalizing weight to prevent imbalance of said piston.

18. The swash-plate machine according to claim 17, including at least one balancing weight disposed in said radial recess for equalizing weight and avoiding imbalance of said piston.

19. The swash-plate machine according to claim 1, including at least one balancing weight associated with said piston for equalizing weight and avoiding imbalance of said piston.

20. The swash-plate machine according to claim 1, wherein said shaft seals include a radial packing ring with a stuffing box.

21. The swash-plate machine according to claim 1, wherein said shaft seals include a slide ring seal.

22. The swash-plate machine according to claim 1, including knife-like ribs defining radially extending grooves at least at some regions of at least one of said end surfaces of said piston.

23. The swash-plate machine according to claim 22, wherein said region of said piston having said radial grooves is a sector of a circle having an angle bisecting line extending at right angles to an axis of said radial slit in said piston.

24. The swash-plate machine according to claim 22, wherein said radial grooves are disposed on both of said piston surfaces.

25. The swash-plate machine according to claim 22, wherein one of said surfaces of said piston is a pressure surface having said grooves in a sector with one side adjoining said radial slit.

26. The swash-plate machine according to claim 22, wherein said lateral surfaces of said work chamber are inner wall surfaces, and said region of said piston having said radial grooves has beveling and is in contact with said inner wall surfaces.

27. The swash-plate machine according to claim 22, wherein said grooves have a quadrilateral profile.

28. The swash-plate machine according to claim 22, wherein said grooves have a rectangular profile.

29. The swash-plate machine according to claim 22, wherein said grooves have a rectangular profile with a flat groove bottom.

30. The swash-plate machine according to claim 22, wherein said grooves have a longitudinal axis and a bottom being curved relative to the longitudinal axis.

31. The swash-plate machine according to claim 22, wherein said grooves have beveled groove sides.

32. The swash-plate machine according to claim 22, wherein said grooves have asymmetrically beveled groove sides.

33. The swash-plate machine according to claim 22, wherein said grooves have a V profile with a narrow groove bottom.

34. The swash-plate machine according to claim 22, wherein each of said grooves has sides facing toward said radial slit and less steep opposite sides.

35. The swash-plate machine according to claim 22, wherein each of said grooves has a groove bottom, groove sides disposed at a positioning angle toward said radial slit of from 105° to 120° relative to said groove bottom and opposite groove sides disposed at a positioning angle of >135° relative to said groove bottom.

36. The swash-plate machine according to claim 22, wherein said positioning angle of from 105° to 120° is 112°.

37. The swash-plate machine according to claim 22, wherein said grooves have a groove bottom, and each of said knife-like ribs defining said grooves has a blade-like outer edge and a base on said groove bottom being broader than said outer edge and reinforcing said respective rib.

38. The swash-plate machine according to claim 22, wherein said knife-like ribs are surface-hardened.

39. The swash-plate machine according to claim 22, wherein said knife-like ribs have a coating with a wear-resistant material.

40. The swash-plate machine according to claim 22, including a groove bottom receiving said knife-like ribs and being constructed as a separately manufactured piston part being joined to said piston.

41. The swash-plate machine according to claim 22, wherein said piston has a beveled region, and said knife-like ribs are separate inserts of hard metal that are inserted into said beveled region.

42. The swash-plate machine according to claim 1, wherein said piston has a soft coating at least in some regions.

43. The swash-plate machine according to claim 42, wherein said soft coating is rubber.

44. The swash-plate machine according to claim 43, wherein said piston is formed of steel, and said soft coating of rubber is vulcanized onto said piston.

45. The swash-plate machine according to claim 42, wherein said soft coating is an impact-resistant plastic.

46. The swash-plate machine according to claim 45, wherein said impact-resistant plastic is Acryl-Butadiene-Styral(ABS).

47. The swash-plate machine according to claim 1, wherein said piston is formed of non-rusting material.

48. The swash-plate machine according to claim 47, wherein said non-rusting material is steel.

49. A swash-plate machine, comprising:

a hollow spherical work chamber having a given diameter and being laterally defined by opposed lateral surfaces;

a partition dividing said work chamber into at least one high-pressure chamber and at least one low-pressure chamber;

a conduit system for conducting an operating medium into said chambers;

a piston carrier up to which said partition extends;

a plate-like sealing strip cooperating with said partition;

a circular piston having a circumference and a swivel stroke, said piston being adapted to said given diameter and tapering outwardly toward the circumference;

a supported drive shaft through which said circular piston is connected to the outside for effecting a tumbling motion of said piston, said drive shaft having an axis of rotation;

said piston having at least one radial slit extending radially therein from the circumference of said piston approximately to said piston carrier, defining slit sides being adapted to the swivel stroke of said piston and defining a slit bottom with a radius;

a guide journal being inserted in said slit and cooperating with said partition;

said piston having end surfaces being in contact with said opposed lateral surfaces, said opposed lateral surfaces extending perpendicularly to the axis of rotation of said drive shaft;

said partition having an end surface engaging said radial slit, said slit bottom and said end surface of said partition each having a spherical curvature being matched to one another and adapted to the radius of said slit bottom; and a housing having a leadthrough formed therein for said drive shaft, shaft seals, and an impact disk disposed in the vicinity of said leadthrough for protecting said shaft seals against mechanical damage from a pressure stream of a lubricating medium.

50. The swash-plate machine according to claim 49, wherein said housing has vent conduits formed therein, and said impact disk and said vent conduits are each disposed at a lowest point below said seals, for keeping the vicinity of said leadthrough in said housing for said drive shaft leakage-free.

* * * * *